United States Patent [19]

Kodaira et al.

[11] 4,244,291

[45] Jan. 13, 1981

[54] PRINTER WITH A FIXED AND AN AXIALLY MOVABLE CHARACTER RING

[75] Inventors: Kozo Kodaira; Noboru Ito, both of Shiojiri, Japan

[73] Assignee: Kabushiki Kaisha Suwa Seikosha, Tokyo, Japan

[21] Appl. No.: 958,869

[22] Filed: Nov. 8, 1978

[51] Int. Cl.[3] ..... B41J 1/24

[52] U.S. Cl. ..... 101/99; 101/93.17; 101/93.45; 400/155; 400/317.1

[58] Field of Search ..... 400/155, 149, 185, 317, 400/317.1, 317.3; 101/93.09, 93.22, 93.11, 93.12, 93.15, 93.17, 93.45, 99, 110; 235/61.9 R

[56] References Cited

U.S. PATENT DOCUMENTS

| | | | |
|---|---|---|---|
| 3,310,147 | 3/1967 | Clay et al. | 400/149 |
| 3,374,873 | 3/1968 | Takenaka | 400/154.2 |
| 3,643,596 | 2/1972 | Varbach et al. | 400/155 X |
| 3,957,151 | 5/1976 | Kashio | 400/154.5 |
| 4,051,942 | 10/1977 | Suzuki et al. | 400/149 |
| 4,104,967 | 8/1978 | Okabe | 101/99 |
| 4,152,982 | 5/1979 | Mikoshiba et al. | 101/99 X |
| 4,161,912 | 7/1979 | Usui et al. | 101/99 |

*Primary Examiner*—Edward M. Coven

*Attorney, Agent, or Firm*—Blum, Kaplan, Friedman, Silberman & Beran

[57] ABSTRACT

A serial printer includes two character rings having raised characters disposed therearound. Both rings rotate on a common axis for selection of characters for printing. One character ring is laterally fixed relative to the common axis; the other character ring translates laterally along the common axis in a carriage driven by a pulley and wire, and biased for quick return. A solenoid actuated claw selects characters for printing as the character rings rotate. A single motor operating in a forward direction causes the character rings to rotate while character selections are made, sequentially causes a single hammer to strike both character rings simultaneously for printing on paper, and translates the carriage one position for serially printing the next digit in a number. Reversal of the motor, after a line of characters is printed, causes release and return of the carriage and advancement of the paper.

24 Claims, 7 Drawing Figures

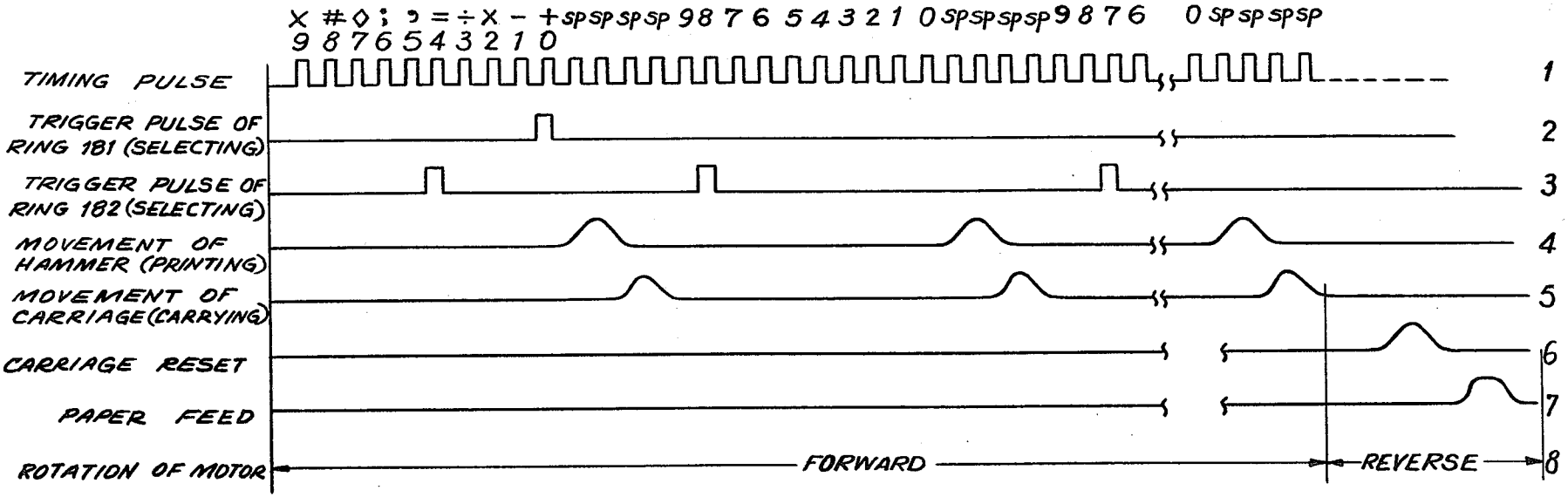
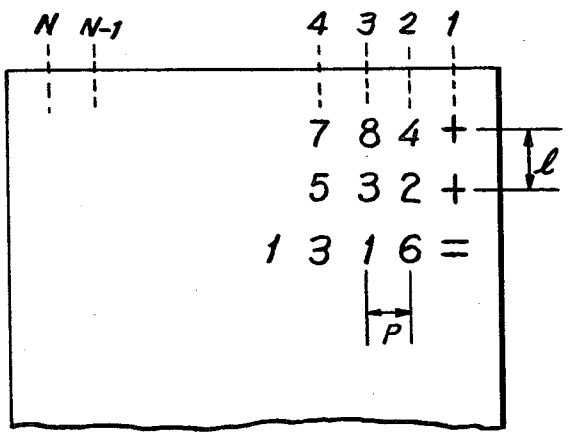
FIG. 7

PRINTER WITH A FIXED AND AN AXIALLY MOVABLE CHARACTER RING

BACKGROUND OF THE INVENTION

This invention relates generally to an electromechanical serial printer and more particularly to a serial printer for printing characters in a line by moving one of two character rings in a lateral direction. In the prior art, dot printers have been used wherein the characters are constituted of a plurality of tiny dots. However in many instances, the printed character became obscure and the structure of the dot head for producing the dots on the paper was complicated and expensive. In other printers the number of print rings was made equal to the number of columns or digits which were to be printed in a single lateral line. Such an apparatus was costly and complicated and generally required separate circuitry including a solenoid plunger associated with each individual print ring in order to set the characters for printing.

What is needed is a serial printer providing the quality in printing normally achieved with pring rings but not having the complexity of a printer having an individual print ring associated with each digit in a serial number which is to be printed.

SUMMARY OF THE INVENTION

Generally speaking, in accordance with this invention, a serial printer is provided which includes only two character rings having raised characters disposed therearound. Both rings rotate about a common axis for selection of characters for printing. One character ring is laterally fixed relative to the common axis; the other character ring translates laterally along the common axis in a carriage drawn by a pulley and wire. As the character rings rotate, solenoid actuated claws select the characters on each ring for printing. Through a train of gears, a single motor causes the character rings to rotate until character selection is made, and through a system of cams and levers causes a single hammer to strike both print rings for printing on paper after the character selection has been made. Then continued operation of the motor translates the carriage holding the translatable character ring by one position or column for printing the next digit in a number. The steps of rotating the character rings, selecting characters and printing is repeated until an entire line of print is completed. Then, reversal of the motor after the line is printed, causes release and return of the carriage to the first digit standby position and advancement of the paper by a linkage mechanism.

Accordingly it is an object of this invention to provide a serial printer which is simple and economical in construction.

Another object of this invention is to provide a serial printer which is small-sized and light in weight.

A further object of this invention is to provide a serial printer which provides clearly printed characters.

Still another object of this invention is to provide a serial printer which uses a single motor operating in two directions and uses a single hammer for printing.

Yet another object of this invention is to provide a serial printer which utilizes a laterally translatable print ring for printing the characters in a line of print.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 6 is a timing chart showing the relationship of principal movements and functions in the operation of the serial printer of FIG. 1; and FIG. 7 shows the recording paper used in the serial printer of this invention with an illustrative numerical example printed thereon.

DESCRIPTION OF A PREFERRED EMBODIMENT

Figure 1:
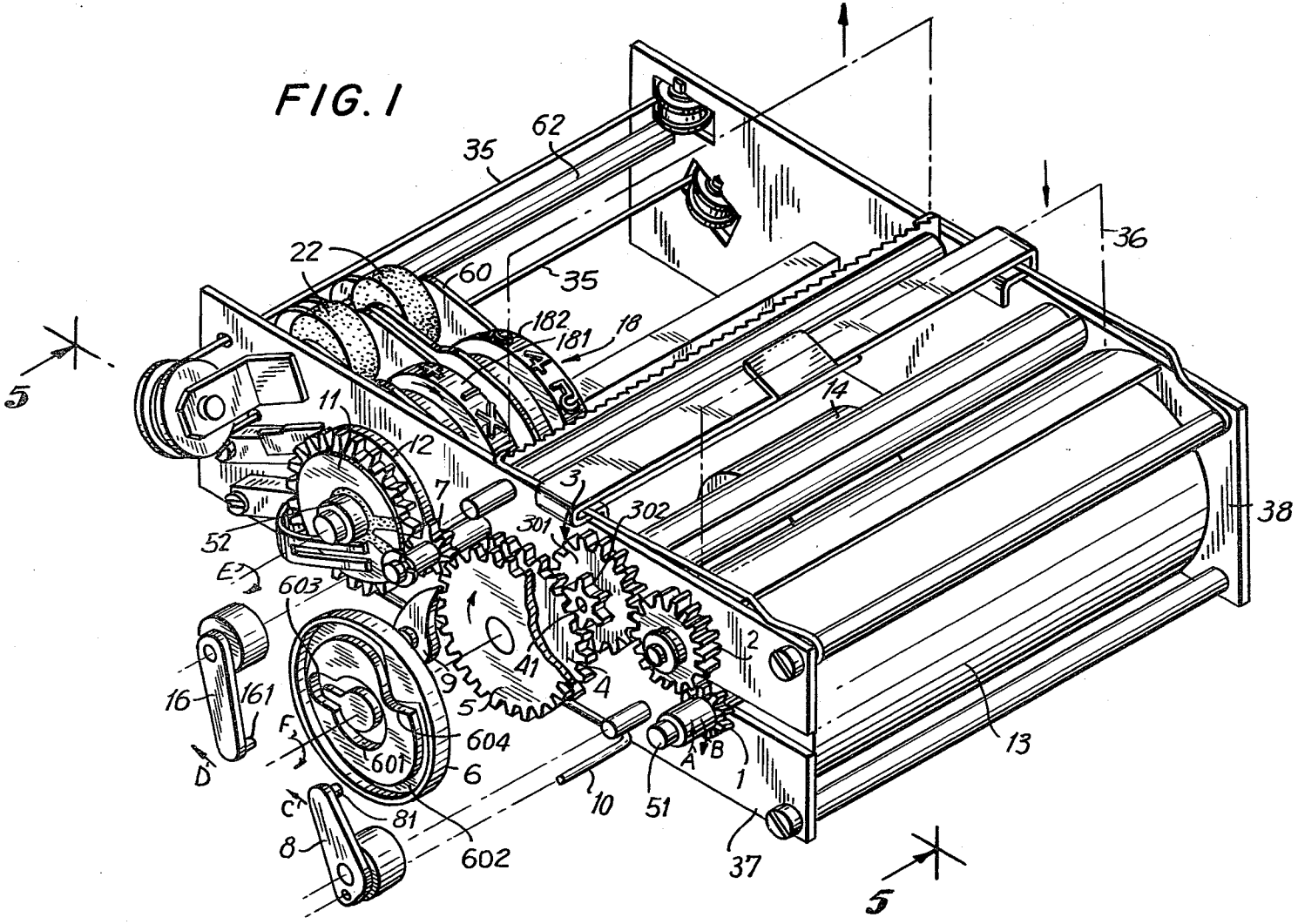
FIG. 1 is a perspective view of a serial printer of this invention with the elements on one side partially exploded.
Figure 3:
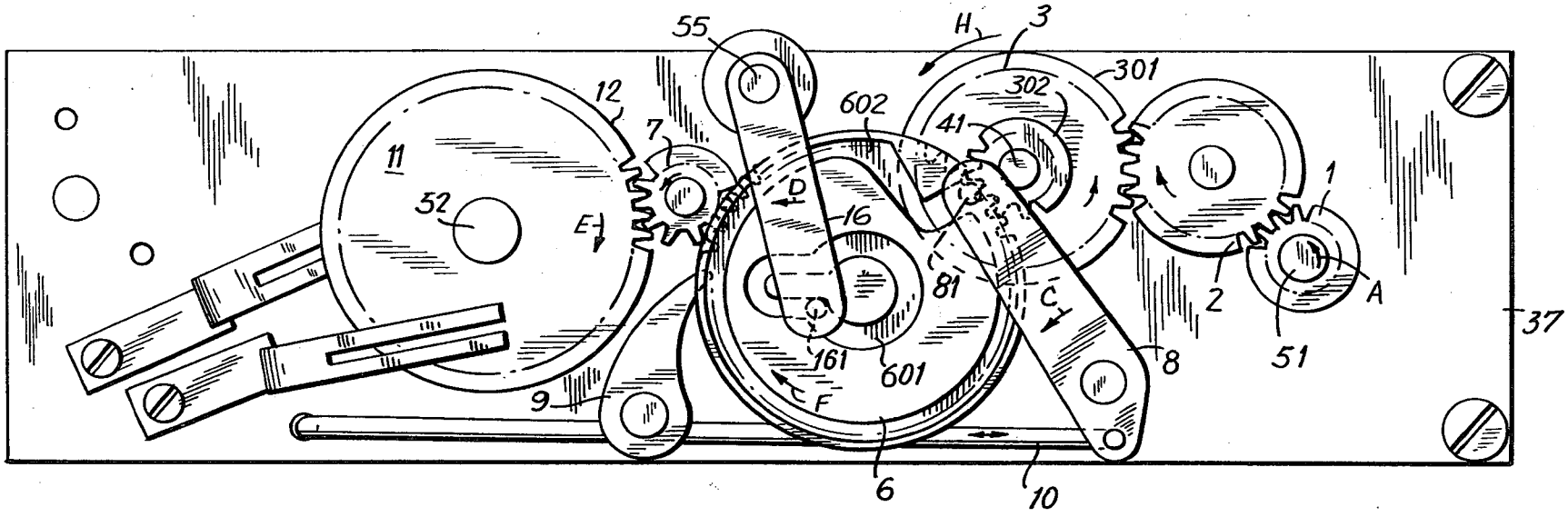
FIG. 3 is a side elevational view of the exploded side of FIG. 1.
Figure 5:
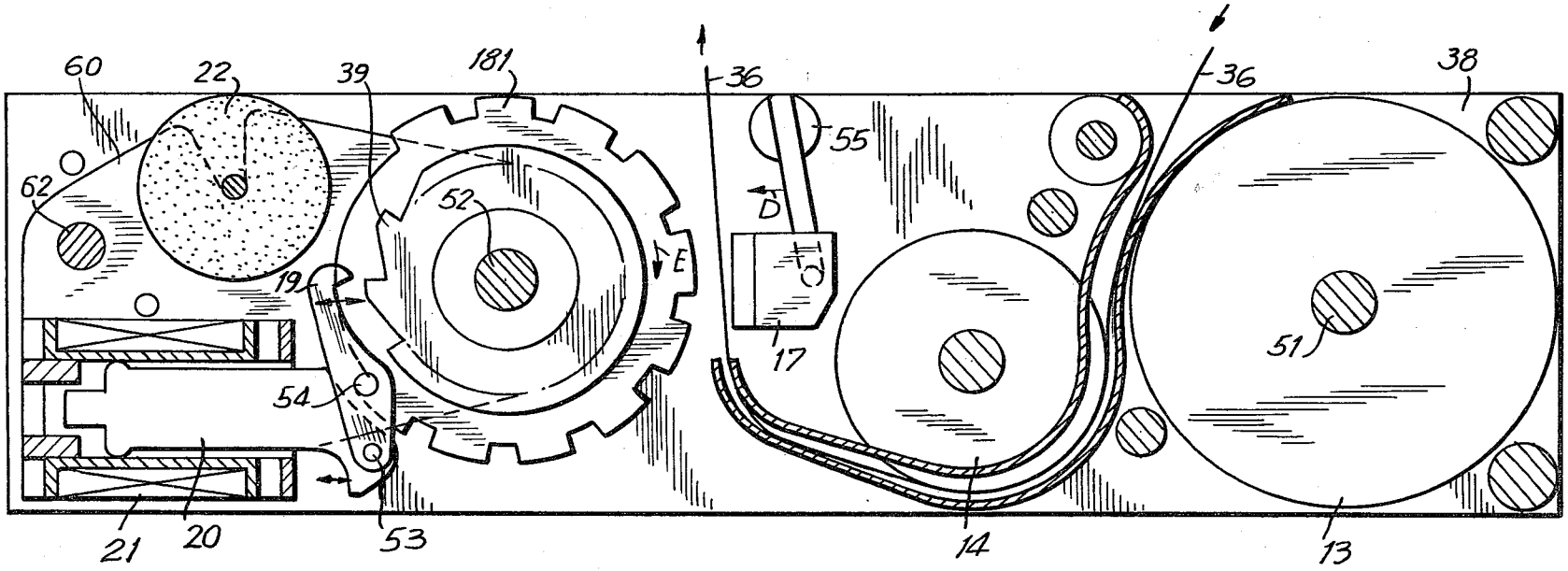
FIG. 5 is a view taken along the line 5—5 of FIG. 1 showing inside structure.

With reference to FIGS. 1, 3 and 5, the printing action of the serial printer of this invention is first described. The printing cycle begins when the motor 13 receives an external signal to activate the motor. Motor 13 rotates in the direction indicated in FIG. 1 by the arrow A. The drive wheel 1 is connected to the shaft 51 of the motor 13 and rotates therewith to drive the following wheel 2. In turn, the following wheel 2 drives the transmitting wheel 301 and transmitting wheel 302 connected thereto. The teeth of transmitting wheel 302 engage the first clutch wheel 4 which is frictionally connected to cam wheel 5. The cam 6 rotates with cam wheel 5 in the direction indicated by the arrow F. As best seen in FIGS. 1 and 3, the cam 6 is provided with first and second cam grooves 601, 602. The pin 161 arranged at the end of the hammer lever 16, is loosely set in the first groove 601, and a pin 81 secured at the end of the character reset lever 8 is loosely set in the second groove 602.

The intermediate wheel 12 connects to the shaft 52, and is rotated by the intermediate wheel 7, and the cam wheel 5 in the direction indicated by the arrow E. Prior to the selection of characters for printing, the print character rings 181 and 182 rotate with the shaft 52 until a character selection is made. A timing detection plate 11 rotating with the intermediate wheel 12 is used in a mechanical wiper or electro-optical arrangement which provides a series of electrical signals (FIG. 6) indicative of the position of the shaft 52 and the print characters on the rings 181, 182. The position signals from detection plate 11 are fed into an external control unit (not illustrated) which outputs signals for the selction of a character on the print ring which is to be printed. When the character on the print ring which is desired for printing arrives in the position opposed to the hammer 17, the trigger coil 21 of a solenoid (FIG. 5) is electrically actuated and the coil plunger 20 is caused to move leftward. The selecting claw 19, pivotally attached to the coil plunger 20 by pin 53, pivots about the pin 54 and engages the ratchet wheel 39 which is attached to the side of the print ring 181. This prevents further rotation of the print ring until after printing has been accomplished. It should be understood that each print ring 181, 182 has an independent trigger coil 21 and trigger coil plunger 20 such that each print ring can be set for the selection of an individual character without regard to the selection made on the other ring. The motor 13 and the cam wheel 6 continue to rotate after the character selection is completed. As the cam 6 rotates, pin 161 attached to the hammer level 16 and engaging the first groove 601 of the cam 6, slides into the projecting portion 603 of groove 601. By following the cam, the hammer lever 16 and the hammer 17 coupled to the hammer lever 16 are moved in the direction indicated by the arrow D. Accordingly the hammer 17 strikes the desired character which is opposed on the character print rings 181, 182 through the medium of the intervening recording paper 36. The hammer 17 extends substantially the entire width of the printer between the opposite side frames 37, 38. Thus, regardless of the position of the translatable print ring 182, the characters which have been selected on both rings 181, 182 are printed simultaneously by the action of the hammer 17. As seen in FIG. 7, two characters, that is, characters in each of two laterally spaced columns, i.e. columns 1 and 2, are printed at the same time. In the first action of the print hammer 17 in a print cycle, the two print wheels, 181, 182 will be located so as to print the two righthanded columns on the paper (FIG. 7). If the printed line is to contain more than two characters spaced laterally apart, then additional characters are added to the same line by movement of the print ring 182 to the left by one column at a time, allowing the printing of an additional character at each column position until the entire line, e.g. a number, is completed in serial form. The print ring 181 at the most right-handed position remains laterally fixed at all times.

After each printing action of the hammer 17, the solenoid 20 is deenergized causing the selecting claw 19 to release the ratchet wheel 39, allowing the character print rings 181, 182 which are spring biased to return to a standby condition ready for the next character selection.

Figure 2:
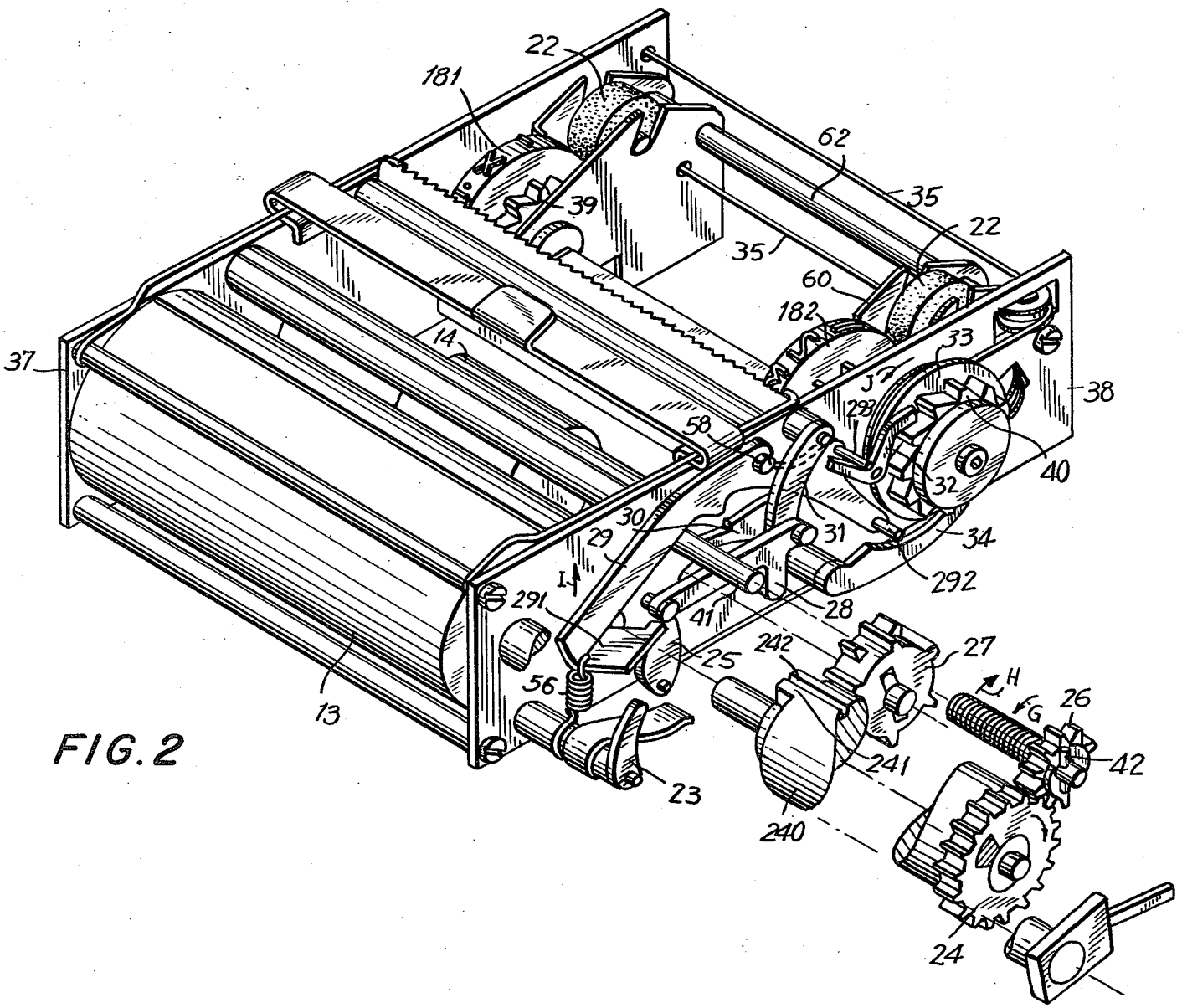
FIG. 2 is a perspective view of the serial printer of this invention showing the other side partially exploded.
Figure 4:
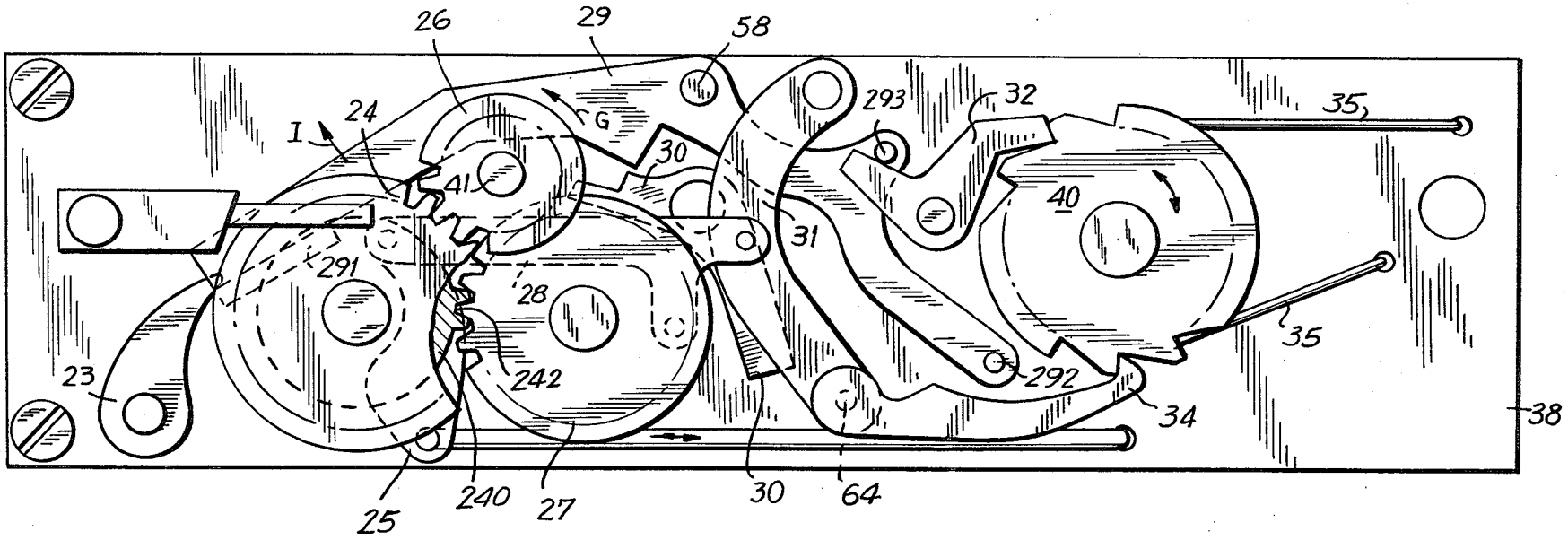
FIG. 4 is a side elevational view of the exploded side of FIG. 4.

The action for laterally translating the character print ring 182 is now described. After a printing action of hammer 17 is completed, the cam 6 continues to rotate in the direction indicated by the arrow F. The continued tracking of pin 161 around continuous cam 601 causes the hammer 17 to return to its original position, disengaged from the paper and the print ring. After a printing motion of the hammer 17 is completed, the cam 6, pin 81, and the first character reset bar 8, are in the positions shown in FIG. 3. As the motor 13 and cam 6 continue to rotate, the pin 81 slides into the recess portion 604 of the second cam 602. The first character reset lever 8 is driven in the direction indicated by the arrow C in FIGS. 1 and 3. The second character reset lever 25, which is provided on the opposite frame 38, is also driven through the action of the character reset bar 10. This movement of character reset lever 25 is transmitted to the carrier arm 28, carrying lever 31, and carrying pawl 34 (FIGS. 2 and 4). Thus the cam shape 604 causes the pawl 34 to extend to the right (FIG. 4) and engage the next tooth on the ratchet wheel 40. Continued rotation of the motor 13 and cam 6 causes pawl 34 to withdraw to the left and rotate ratchet wheel 40 by one tooth. The pulley 33, rigidly attached to and rotating with the ratched wheel 40, is rotated and winds up the wire 35 attached to the carriage 60 which supports the print character ring 182 along with its associated solenoid coil 21 and plunger 20. The action of the pawl 34 in rotating the pulley 33 opposes a spring (not shown) which biases the pulley 33 to return in the direction indicated by the arrow J in FIG. 2. However the ratchet lock pawl 32 prevents back rotation of the ratchet 40 and pulley 33 until the time of release as described more fully hereinafter. Advancement of the ratchet 40 by one tooth translates the carriage 60 by a pitch distance P as shown in FIG. 7 and displaces the character print ring 182 in position for printing, for example, the next most significant digit in a laterally spaced serial number.

At each position of the character print ring 182, a printing operation is performed as described above. The hammer 17, because of its extended length strikes characters on both character print rings simultaneously at all lateral positions of print ring 182. However, after character print ring 181 has printed its first character, for example, a "+" sign as shown in FIG. 7, the external character selector control unit (not shown) will then select a blank space on character print ring 181 for all subsequent printing positions of character print ring 182 during the serial printing of an entire laterally spaced number. Thus if the first action of the hammer 17 in printing a serial number causes the character print ring 181 to print, for example, a "+" sign, then until the entire number is completely printed, the fixed character print ring 181 will print nothing more. Printing of one entire line is completed by repeating the above-mentioned character selection, printing, and translation of the character print ring for the required number of times, N, as indicated in FIG. 7. Characters can be omitted at any column by selecting a blank space on the character ring in opposition to the hammer 17.

After a line has been finished, (FIG. 2), it is necessary to advance the paper and to return the character ring 182 to its original position (FIG. 1) adjacent the laterally fixed character ring 181. This is done by reversing the rotational direction of the motor 13 as indicated by the arrow B in FIG. 1. It should be noted that when the motor 13 is reversed, the intermediate wheel 12 connected to the character wheels 181, 182, and cam wheel 5 connected to cam 6, are prevented from reverse rotation by the pawl 9 which engages the teeth on cam wheel 5. The reversed motion of the motor 13 is transmitted via drive wheel 1, following wheel 2, transmitting wheel 301 and transverse shaft 41 to the clutch wheel 26 shown in FIG. 2. During the printing process, described previously, the second clutch wheel 26 is at a standstill even though the transmitting wheel 3 is rotating in the direction indicated by arrow H in FIG. 2. That is, when the shaft 41 is turning in the direction indicated by the arrow H, as it would during the printing operations, the pin 42 provided through the shaft 41 slides on the side surface of the clutch wheel 26 in order to prevent the second clutch wheel 26 from rotating. When the motor 13 is operating in reverse and the shaft 41 is rotating in the direction indicated by the arrow G, then the clutch wheel 26 rotates to drive the paper feed wheel 24. Also as the paper feed wheel 24 is rotated, the cam 240, which is connected to or in one body with the transmitting wheel 24, rotates in unison. A projecting portion 241 of the cam 240 pushes upwardly on one end 291 of the column reset lever 29 as indicated by the arrow I in FIG. 2 and FIG. 4. The column reset lever 29 pivots about shaft 58 causing the attached pin 293 to press downwardly on the ratchet pawl 32 thereby releasing the pawl 32 from the ratchet wheel 40. Simultaneously, the pin 292 connected to the column reset lever 29 presses downwardly on the carrying pawl 34 releasing it from the ratchet wheel 40. Accordingly the ratchet 40 is free from restraint and the aforementioned spring (not shown), which biases the ratchet wheel 40 and carrying pulley 33, causes the carriage 60 bearing the print character ring 182 to return to its original standby position adjacent to the laterally fixed print character ring 181. As the paper feed wheel 24 and carriage release cam 240 continue to turn, the elevated portion 241 disengages from the column reset lever 29. Pulled by the tension spring 56 acting on the end 291 of the column reset lever 29, the lever 29 pivots about shaft 58 allowing the ratchet pawl 32 to fall into engagement again with ratchet wheel 40. The carrying pawl 34, biased by a spring (not shown) swings back into engagement with a tooth of the ratchet wheel 40 and thus the serial printer of this invention is ready for the next print cycle. The rotational motion of the ratchet wheel 40 and the pulley 33 in returning the carriage 60 to its standby position is indicated in FIG. 2 by the arrow J. The paper transmitting wheel 24 continues to rotate until the tooth 242 on the cam 240 engages with a tooth of the paper feeding wheel 27 whereby the paper feeding roller 14 is rotated by the pitch distance l as shown in FIG. 7. The paper feeding roller 14 is on a shaft coaxial with the paper feeding wheel 27. An ink roller 22 is associated with each character print ring 181, 182. As the print rings 181, 182 are rotated, the raised surfaces of the characters are wetted with ink which is then available for impression on the paper 36.

FIG. 6 is a timing chart showing the cycle to print an entire line on the paper 36. In the example illustrated in FIGS. 6 and 7, the number 784 is printed with a 'plus' sign to the right. The number is printed starting with the least significant digit and progressing toward the most significant digit. The 'plus' sign is printed from the character ring 181 whose raised characters are not numbers but rather are symbols such as plus, minus, a division sign, and so forth as desired by the designers of the calculator or device in which the printer is used. The timing pulses in the upper line of FIG. 6 are those derived through use of the detector plate 11 connected to the shaft 52 which drives the print character rings 181, 182. It should be noted in the given example that there are timing pulses for the characters 9 down to 0, followed by four empty spaces indicated by the mark sp. Then the cycle repeats. Whereas the character print ring 181 had symbols for its characters, the character print ring 182 has the numbers from 9 down to 0; each ring has four empty spaces. On the second line of FIG. 6, it is illustrated that the laterally fixed character ring 181 is triggered by the solenoid 21 to select a 'plus'. Just prior to that time, the character ring 182 is triggered by its solenoid to select a 4. With reference to the fourth waveform of FIG. 6, it is shown that the hammer 17 strikes after the characters have been selected and after the eleventh timing pulse. The carriage is then translated laterally shortly after the hammer 17 strikes (line 5, FIG. 6) by a distance P shown in FIG. 7, that is, from column 1 leftward to column 2. It should be noted that thereafter, in subsequent timing cycles, character ring 182 prints an 8 and a 7, whereas the character ring 181 prints nothing since it is positioned by the solenoid 21 so that an empty space sp is located opposite to the hammer 17. The lower waveforms (lines 6, 7 of FIG. 6) show that the carriage is reset and then the paper 36 is advanced following the final printing of a character in the column N, and following reversal of the motor 13 (line 8 of FIG. 6). It will be readily understood, where the number to be printed does not require N lateral positions, that the external control (not shown) which determines the reversal time for the motor may deliver an early reversal signal to promptly begin a new line and speed up the printing process.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A serial printer for printing characters serially in a laterally spaced pattern forming a line of characters on paper, comprising:

a single reversible motor;

a first character print ring having print characters peripherally disposed therearound;

a second character print ring having print characters peripherally disposed therearound;

means for rotating said first and second character print rings driven in unison by said single motor when said motor rotates in a first direction;

means for selecting and positioning a character on each of said character print rings for printing;

hammer means for pressing said paper between said character print rings and said hammer, whereby said selected character on each of said character print rings is simultaneously printed;

means for driving said hammer means, said means for driving including said single motor;

means including said single motor for laterally translating at least one of said character print rings from a standby condition, whereby said laterally spaced pattern of characters can be serially printed; and means including said single motor for returning said at least one translated character print ring to said standby condition when said motor rotates reversely to said first direction.

2. The serial printer of claim 1, and further comprising means including said single motor for advancing said paper when said motor is reversed, whereby an additional line of characters may be printed.

3. The serial printer of claim 1, wherein said means for laterally translating translates only said second character print ring.

4. The serial printer of claim 1 and further comprising ink pads associated with each of said character print rings, whereby said characters are wetted with ink when said character print rings rotate.

5. The serial printer of claim 1, wherein said means for selecting said characters for printing include detecting means for monitoring the rotational position of said character print rings and producing timing signals corresponding to the positions of said characters.

6. The serial printer of claim 5, wherein said means for selecting and positioning said characters comprise a first ratchet wheel associated with each of said character print rings, a first pawl mounted for intermittent engagement with each said first ratchet wheel, and a solenoid to drive each said first pawl against the associated first ratchet wheel whereby character ring rotation is stopped for printing.

7. The serial printer of claim 1, wherein said means for rotating said first and second character print rings in unison includes gears connected to said motor.

8. The serial printer of claim 7 and further including first cam means for driving said hammer means said first cam means moving in synchronism with said gears, whereby said first cam position and said hammer pressing is synchronized with said rotation of said character print rings.

9. The serial printer of claim 7, wherein said means for laterally translating at least one of said character print rings includes a carriage for holding said translatable print rings; a pulley; a wire connected between said pulley and said carriage; and means for rotation of said pulley, rotation of said pulley causing said carriage to translate.

10. The serial printer of claim 1 and further comprising first clutch means positioned intermediate said motor and said character print rings, said first clutch means preventing the reverse rotation of said first and second character print rings when said motor rotates in the reverse direction.

11. A serial printer for printing characters serially in a laterally spaced pattern forming a line of characters on paper, comprising:

a single reversible motor;

a first character print ring having print characters peripherally disposed therearound;

a second character print ring having print characters peripherally disposed therearound;

gear means for rotating said first and second character print rings in unison when said motor rotates in a first direction;

means for selecting and positioning a character on each of said character print rings for printing;

hammer means for pressing said paper between said character print rings and said hammer, whereby said selected character on each of said character print rings is simultaneously printed;

means for driving said hammer means;

means for laterally translating at least one of said character print rings from a standby condition, including a carriage for holding said translatable print rings; a pulley; a wire connected between said pulley and said carriage; and means for rotation of said pulley, rotation of said pulley causing said carriage to translate, said means for rotation of said pulley comprising a ratchet wheel connected to said pulley; a cam; and a pawl driven by said cam, said pawl when driven engaging and advancing said ratchet, whereby said carriage translates to provide a space between serially printed characters.

12. The serial printer of claim 11, wherein said cam and a second cam are driven in synchronism whereby sequential driving of said hammer means for printing and translation of said carriage bearing said translatable character print rings is provided.

13. The serial printer of claim 11, and further comprising first clutch means positioned intermediate said motor and said character print rings, said first clutch means preventing the reverse rotation of said first and second character print rings when said motor rotates in the reverse direction.

14. The serial printer of claim 11, wherein means for returning said carriage includes a second cam moving in synchronism with said gear means, said second cam causing said pawl to disengage from said ratchet wheel on said pulley, whereby said pulley is free to rotate.

15. The serial printer of claim 14 and further comprising means for release prevention of said pawl from said ratchet wheel when said motor operates in said first direction.

16. The serial printer of claim 15, wherein said motor changes from said first direction to said reverse direction after said carriage has translated and said line of characters has been printed on said paper.

17. The serial printer of claim 11 wherein said hammer means includes a single hammer for simultaneously pressing each of said character print rings.

18. A serial printer for printing characters serially in a laterally spaced pattern forming a line of characters on paper, comprising:

a single reversible motor;

a first character print ring having print characters peripherally disposed therearound;

a second character print ring having print characters peripherally disposed therearound;

means for rotating said first and second character print rings in unison when said motor rotates in a first direction, said means for rotating including gears connected to said motor;

means for selecting and positioning a character on each of said character print rings for printing, said means for selecting and positioning said characters including detecting means for monitoring the rotational position of said character print rings and producing timing signals corresponding to the position of said characters, and further including first ratchet wheels, one first ratchet wheel associated with each of said character print rings, first pawls, one first pawl for intermittent engagement with an associated first ratchet wheel, and solenoids, one solenoid coupled for driving each first pawl against the associated first ratchet wheel, whereby character ring rotation is stopped for printing;

hammer means for pressing said paper between said character print rings and said hammer means, whereby said selected character on each of said character print rings is simultaneously printed on said paper;

means for driving said hammer means, said hammer means driving means including first cam means, said first cam means moving in synchronism with said gears, whereby said first cam position and said hammer pressing is synchronized with said rotation of said character print rings;

means for laterally translating at least one of said character print rings from a standby condition, whereby said laterally spaced pattern of characters can be serially printed, said means for laterally translating including a carriage for holding said translatable print rings, a pulley, and a wire connected between said pulley and said carriage, means for rotation of said pulley, the rotation of said pulley drawing said wire and causing said carriage to translate, said means for rotation of said pulley comprising a second ratchet wheel connected to said pulley, a second cam moving in synchronism with said gears, and a second pawl driven by said second cam, said second pawl engaging and advancing said second ratchet, whereby said carriage translates to provide a space between serially printed characters; and means for returning said translated character print rings to said standby condition when said motor rotates oppositely to said first direction, said means for returning including a third cam moving in synchronism with said gearing, said third cam causing said second pawl to disengage from said second ratchet wheel on said pulley, whereby said pulley is free to rotate.

19. The serial printer of claim 18, and further comprising first clutch means positioned intermediate said motor and said character print rings, said first clutch means preventing the reverse rotation of said first and second character print rings when said motor rotates in the reverse direction.

20. The serial printer of claim 18, and further comprising means to advance said paper when said motor is reversed, whereby an additional line of characters may be printed.

21. The serial printer of claim 18, wherein said means for laterally translating translates only said second character print ring.

22. The serial printer of claim 18 and further comprising ink pads associated with each of said character print rings, whereby said characters are wetted with ink when said character print rings rotate.

23. The serial printer of claim 18 and further comprising means for release prevention of said second pawl from said second ratchet wheel when said motor operates in the foward direction.

24. The serial printer of claim 18 wherein said hammer means includes a single hammer for simultaneously pressing each of said character print rings.

* * * * *

UNITED STATES PATENT AND TRADEMARK OFFICE

CERTIFICATE OF CORRECTION

PATENT NO. : 4,244,291

DATED : January 13, 1981

INVENTOR(S) : KOZO KADAIRA et al.

It is certified that error appears in the above—identified patent and that said Letters Patent is hereby corrected as shown below:

On the title page, please insert

-- [73] Assignee: Kabushiki Kaisha Suwa Seikosha, Tokyo, Japan and Shinshu Seiki Kabushiki Kaisha, Nagano-ken, Japan --

-- [30] Foreign Application Priority Data

Nov. 8, 1977 Japan..... 52-133763 --

Signed and Sealed this

*Twentieth* Day of *April 1982*

[SEAL]

*Attest:*

GERALD J. MOSSINGHOFF

*Attesting Officer*

*Commissioner of Patents and Trademarks*